US005501620A

United States Patent [19]

Ishii et al.

[11] Patent Number: 5,501,620

[45] Date of Patent: Mar. 26, 1996

[54] ELECTRICAL CONNECTOR

[75] Inventors: Takashi Ishii; Tamio Watanabe; Toru Nagano, all of Shizuoka, Japan

[73] Assignee: Yazaki Corporation, Tokyo, Japan

[21] Appl. No.: 497,453

[22] Filed: Jun. 30, 1995

Related U.S. Application Data

[63] Continuation of Ser. No. 207,681, Mar. 9, 1994, abandoned.

[30] Foreign Application Priority Data

Mar. 10, 1993 [JP] Japan ..... 5-010133 U

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 5,071,373 | 12/1991 | Nagasaka et al. | 439/752 |
| 5,108,319 | 4/1992 | Tsuji et al. | 439/752 |
| 5,139,447 | 8/1992 | Yoneda et al. | 439/752 |
| 5,205,763 | 4/1993 | Watanabe et al. | 439/752 |
| 5,308,265 | 5/1994 | Kaneko | 439/752 |
| 5,322,456 | 6/1994 | Yagi et al. | 439/752 |
| 5,322,457 | 6/1994 | Tsuji et al. | 439/752 |
| 5,350,320 | 9/1994 | Hashizawa et al. | 439/752 |
| 5,397,249 | 3/1995 | Endo et al. | 439/752 |

FOREIGN PATENT DOCUMENTS

| | | |
|---|---|---|
| 4-149972 | 5/1992 | Japan . |
| 4-85577 | 7/1992 | Japan . |
| 5-190229 | 7/1992 | Japan . |

*Primary Examiner*—Gary F. Paumen

*Attorney, Agent, or Firm*—Armstrong, Westerman, Hattori, McLeland & Naughton

[57] ABSTRACT

An electrical connector with a terminal locking member for doubly locking terminals in terminal accommodating cavities in which terminals are smoothly inserted into terminal accommodating cavities in a connector housing and the terminals are doubly locked with certainty. The electrical connector comprises: a housing; terminal accommodating cavities in the housing; a terminal locking member slidably attached to the housing in a preliminarily locked state and a fully locked state; terminal locking pieces formed on inner walls of the terminal accommodating cavities for locking terminals; resilient terminal supporting pieces attached to the terminal locking member for supporting the terminals; lifting projections in the terminal accommodating cavities for lifting the resilient terminal supporting pieces at the preliminarily locked stated of the terminal locking member to permit the terminals to enter the terminal accommodating cavities and to be engaged with the resilient terminal locking pieces; and guide projections formed on the inner walls of the terminal accommodating cavities for guiding the resilient terminal supporting pieces while the terminal locking member moving from the preliminarily locked state to the fully locked state and for locking the terminal at the fully locked stated of the terminal locking member.

5 Claims, 5 Drawing Sheets

ELECTRICAL CONNECTOR

This application is a continuation of application Ser. No. 08/207,681, filed Mar. 9, 1994, now abandoned.

BACKGROUND OF THE INVENTION

1. Field of the Invention

The present invention relates to an electrical connector, and more particularly to an electrical connector with a terminal locking member for doubly locking terminals in terminal accommodating cavities.

2. Description of the Prior Art

FIG. 7 is a perspective view of a conventional electrical connector K with double locking function for terminals, which is disclosed in Japanese Patent Application Laid-Open No. Heisei 4-149972. The electrical connector comprises a connector housing a with a plurality of terminal accommodating cavities and a terminal locking member b which is slidably attached to the connector housing and locked in two rows of a preliminary locked state and a fully locked state.

Resilient plates d with terminal locking projections c are integrally formed with a main frame e of the terminal locking member b as illustrated in FIG. 8.

Under the condition that the connector housing a and the terminal locking member b are in the preliminary locked state, as shown in FIG. 8, the resilient plate d rides on a projection f on the connector housing a and deflects upwardly so that the terminal locking projection c is also lifted upwardly to permit the terminal g to enter the terminal accommodating cavity. Then, the terminal g is fixed in the cavity through a resilient locking piece h.

When the terminal locking member b is further pushed to proceed to the fully locked state as illustrated in FIG. 9, the projection f enters relief notch i of the resilient plate d to permit the plate d to recover its original shape. As a result, an end c1 of the terminal locking projection c abuts the terminal g for double locking.

Further, in the conventional connector with a terminal locking member K described above, the resilient plate d is integrally formed with the terminal locking member b to provide the preliminarily locked state, which allows the terminal g to be pulled out without disconnecting the locking member b from the connector housing However, the connector housing a and the terminal locking member b are formed of synthetic resin, and a position where the resilient plate d contacts the projection f is apart from a position where the end c1 of the terminal locking projection c abuts the terminal g, so that the terminal locking projection c is apt to deflect due to the heat and the resilience of the material at the forming process to cause the end c1 thereof to shift. As a result, the terminal locking projections c may be insufficiently bent upwardly at a preliminarily locked state, which prevents the terminal g from smoothly entering the terminal accommodating cavity b due to the abutment with the end c1 or prevents the terminal g from being doubly locked.

SUMMARY OF THE INVENTION

It is therefore an object of the present invention to eliminate the drawbacks described above and to provide an electric connector with a terminal locking member in which a terminal is smoothly inserted into a terminal accommodating cavity in a connector housing and the terminal is doubly locked with certainty.

The electrical connector according to the present invention comprises: a housing; terminal accommodating cavities in the housing; a terminal locking member slidably attached to the housing in a preliminarily locked state and a fully locked state; terminal locking pieces formed on inner walls of the terminal accommodating cavities for locking terminals; resilient terminal supporting pieces provided with terminal supporting portions having lifting faces attached to the terminal locking member for supporting the terminals; lifting projections in the terminal accommodating cavities for lifting the resilient terminal supporting pieces at the preliminarily locked state of the terminal locking member to permit the terminals to enter the terminal accommodating cavities and to be engaged with the resilient terminal locking pieces; and guide projections formed on the inner walls of the terminal accommodating cavities for guiding the resilient terminal supporting pieces while the terminal locking member moves from the preliminarily locked state to the fully locked state and for locking the terminal at the fully locked stated of the terminal locking member.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
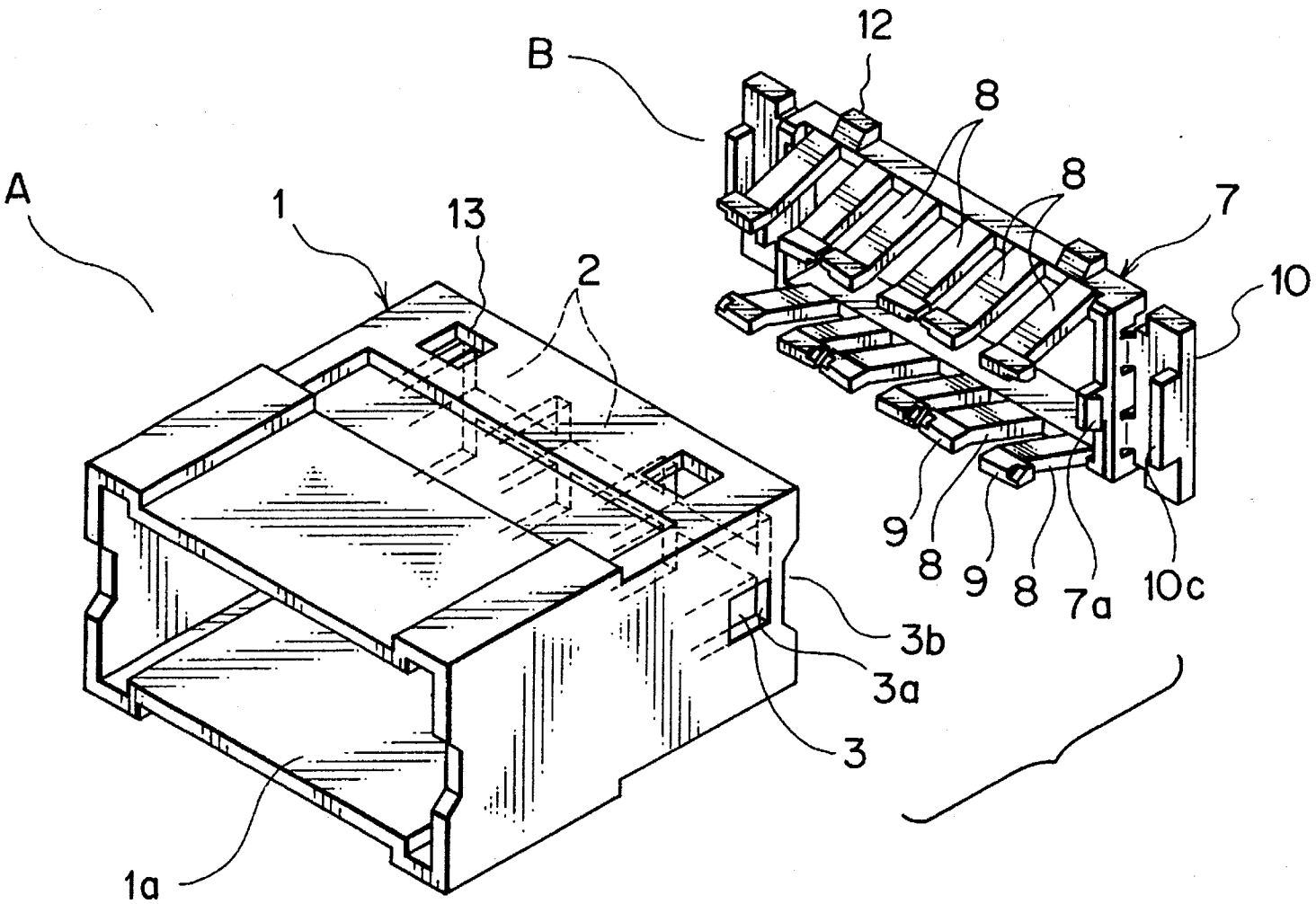
FIG. 1 is a perspective view of a connector housing and a terminal locking member according to an embodiment of the present invention.

FIG. 1 shows a perspective view of a connector housing A and a terminal locking member B constituting an electrical connector according to an embodiment of the present invention.

Figure 2:
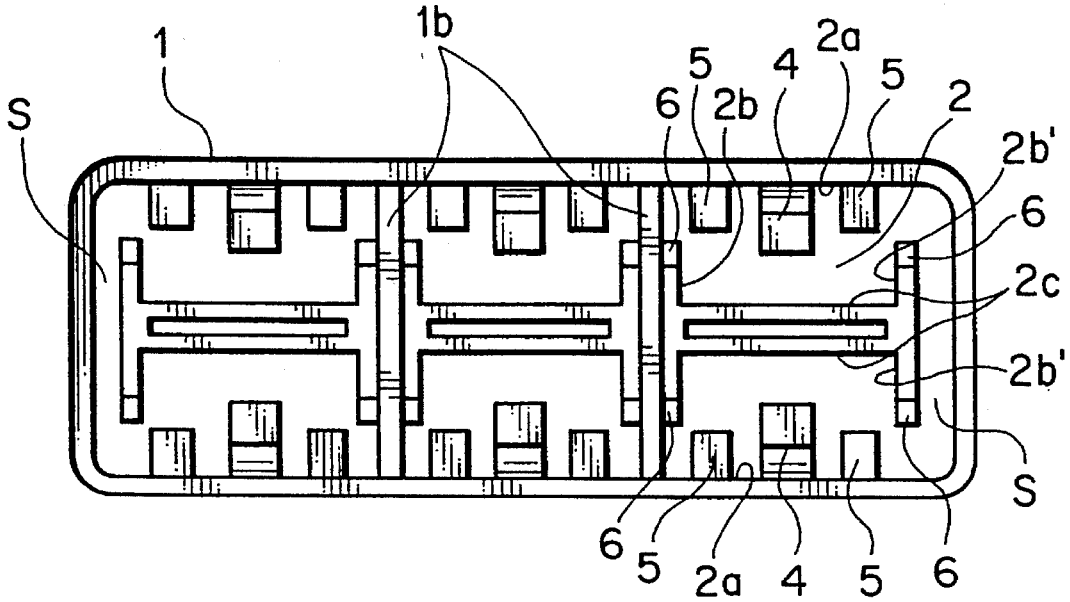
FIG. 2 is a front view of the connector housing shown in FIG. 1.

The connector housing A is formed of synthetic resin, and a frame portion 1*a* a is formed at a front half of the housing A and six terminal accommodating cavities 2 divided by partition walls 1*b* in two rows are provided at a rear half of the housing A as illustrated in FIGS. 1 and 2.

Each of the terminal accommodating cavities 2 is enclosed by side walls 2*b*, 2*b*' and bottom wall 2*c*. A space S is formed at the rear half of the housing A between the terminal accommodating cavities 2 and the outer wall 1.

Figure 3:
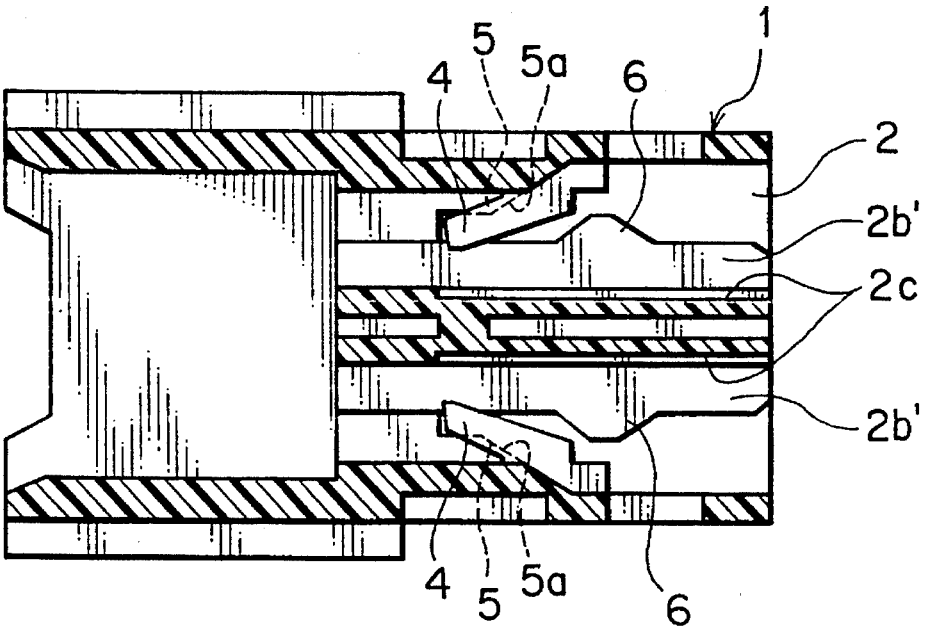
FIG. 3 is a longitudinally cross-sectional view of the connector housing shown in FIG. 2.
Figure 4:
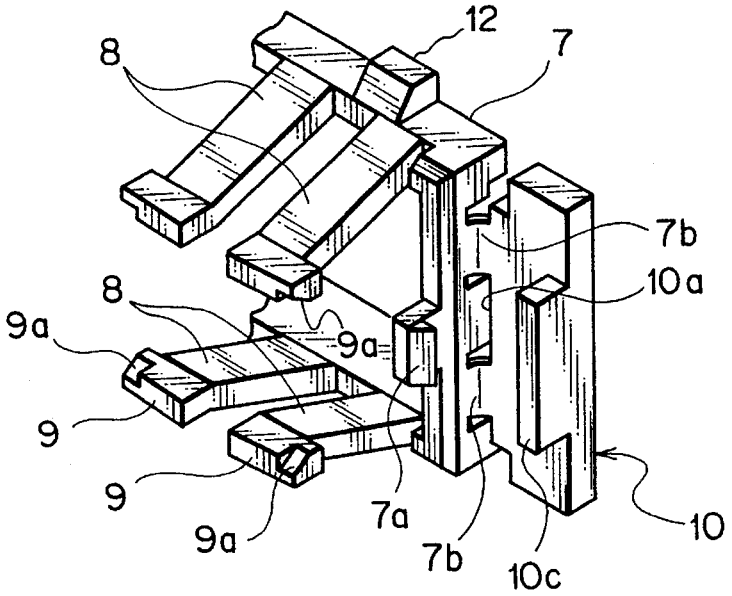
FIG. 4 is an enlarged perspective view of a resilient supporting piece of a terminal locking member according to the embodiment of the present invention.

The terminal accommodating cavities 2 are vertically symmetrical, and resilient locking pieces 4 for terminals C are attached to top walls 2*a* in such a manner that free ends thereof are directed toward the frame portion 1*a* as illustrated in FIG. 3. Further, guide projections 5 with slant, faces 5*a* are attached to the top walls 2*a* with the resilient locking pieces 4 positioned therebetween. Free ends of the guide projection 5 are also directed toward bottom walls 2*c*.

Each of the opposing side walls 2*b* and 2*b*' is provided with a lifting projection 6 for the terminal locking member B.

The terminal locking member B is also formed of synthetic resin to shape a main frame 7, and three pairs of resilient supporting pieces 8 are situated in cantilever fashion extending from the inner surface of each of upper and lower portions of the main frame 7 so as to be inserted into the space S.

Figure 5:
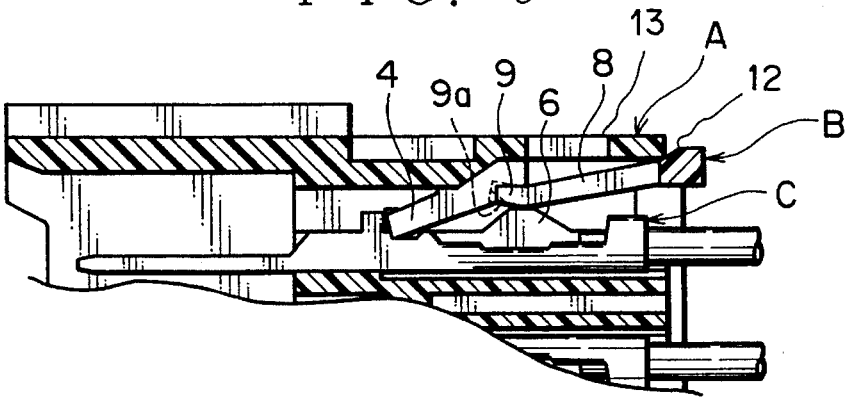
FIG. 5 is a cross sectional view of a preliminarily locked state of the connector housing in FIG. 1 and the terminal locking member.

Terminal locking portions 9 for locking the terminal C are attached to free ends of the resilient supporting pieces 8 and each of the terminal locking portions 9 is notched to provide a lifting face 9*a* for engagement with the lifting projection 6 as illustrated in FIG. 5.

Preliminarily, locking projections 7*a* on both side of the main frame 7 are engaged with locking holes 3*a* which are in communication with locking channels 3 on the outer wall of the connector housing A. Arms 10 are movably attached to the main frame 7 through resilient hinges 7*b*. Holes 10*a* are formed on the arms in the vicinity of the resilient hinges 7*b*, and projections 10*c* are attached to ends of the arms 10 so as to be engaged with the concave portions 3*b* of the connect or housing A.

Final locking of the terminal locking member B to the connector housing A is achieved by the locking engagement which occurs between the fully locking projections 12 which extend outwardly from the terminal locking member main frame 7 and the fully locking holes 13 which penetrate the outer wall 1 of the connector housing A.

In order to insert the terminal C into the connector housing A, the main frame 7 of the terminal locking member B is accommodated in the space S in the connector housing A in advance, with the paired supporting pieces 8 carrying the terminal locking portions 9*a* being each disposed adjacent the opposite sides of the respective resilient locking pieces 4. The preliminarily locking projections 7*a* are engaged with the locking holes 3*a* to obtain a preliminarily locked state, and then the terminal C is inserted into the terminal accommodating cavity 2 as illustrated in FIG. 5.

In FIG. 5, the lifting faces 9*a* of the terminal locking portions 9 ride on the lifting projections 6 to cause the resilient supporting pieces 8 to bend upwardly, which allows the terminal C to smoothly proceed into the terminal accommodating cavity 2 without being interrupted by the supporting pieces 8. Then, the terminal C engages the front end of the resilient locking piece 4 to provide a first locked state of the terminal C in the terminal accommodating cavity 2.

Figure 6:
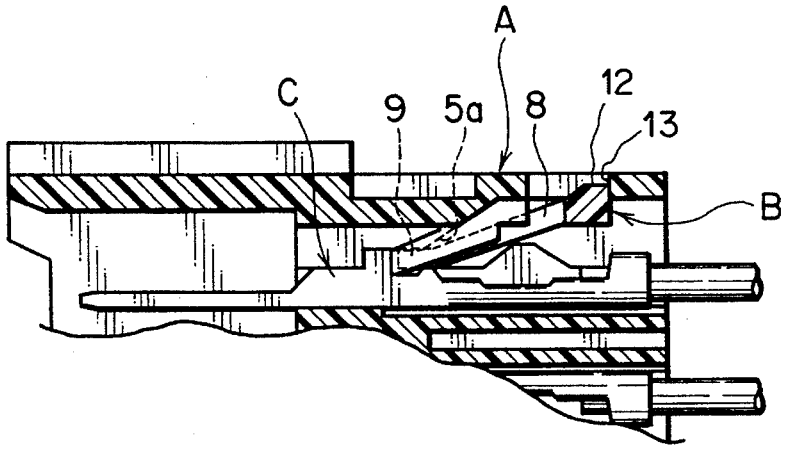
FIG. 6 is a cross-sectional view of a fully locked stated of the connector housing shown in FIG. 1 and the terminal locking member.
Figure 7:
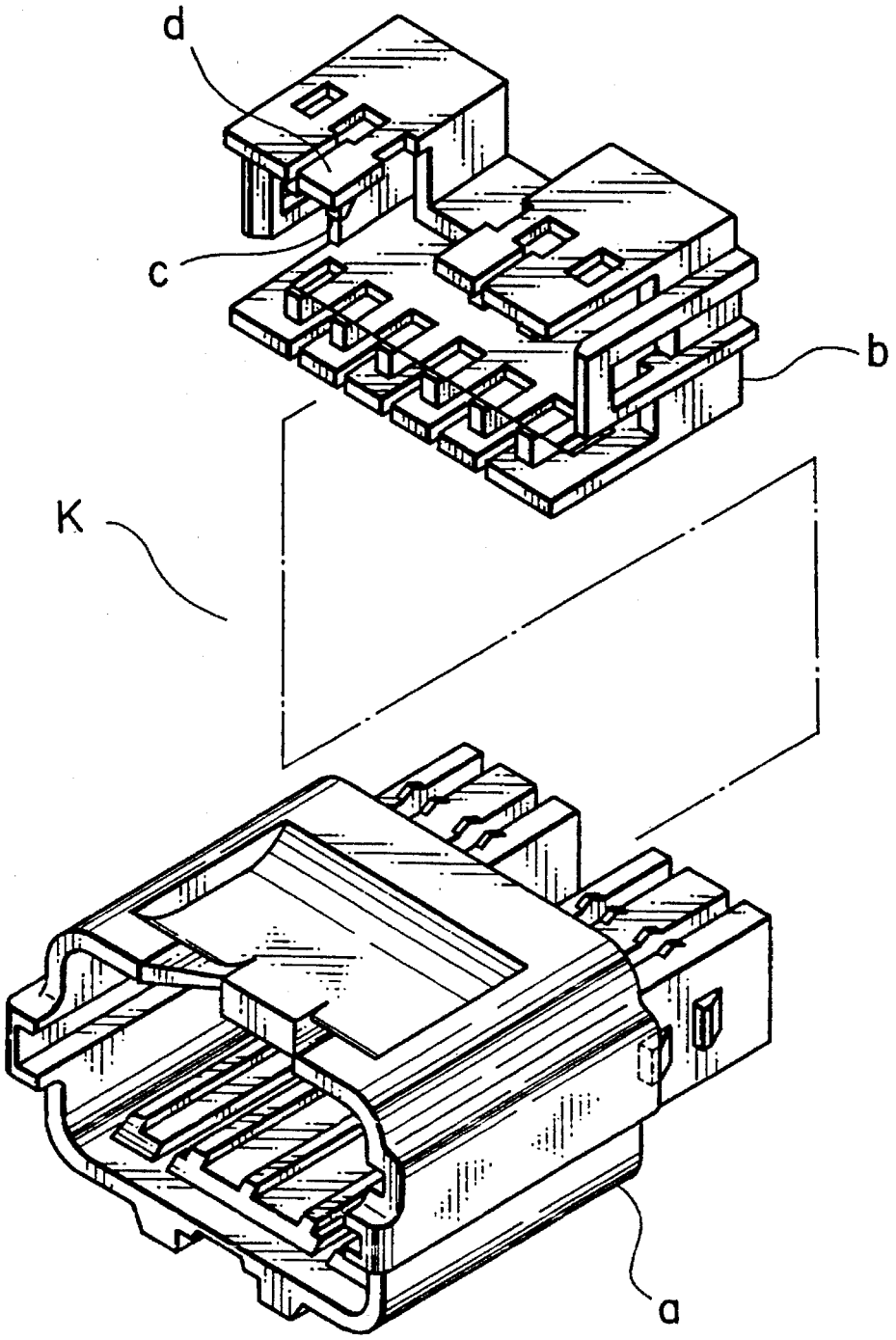
FIG. 7 PRIOR ART
FIG. 7 is a perspective view of a conventional electrical connector with a terminal locking member.
Figure 8:
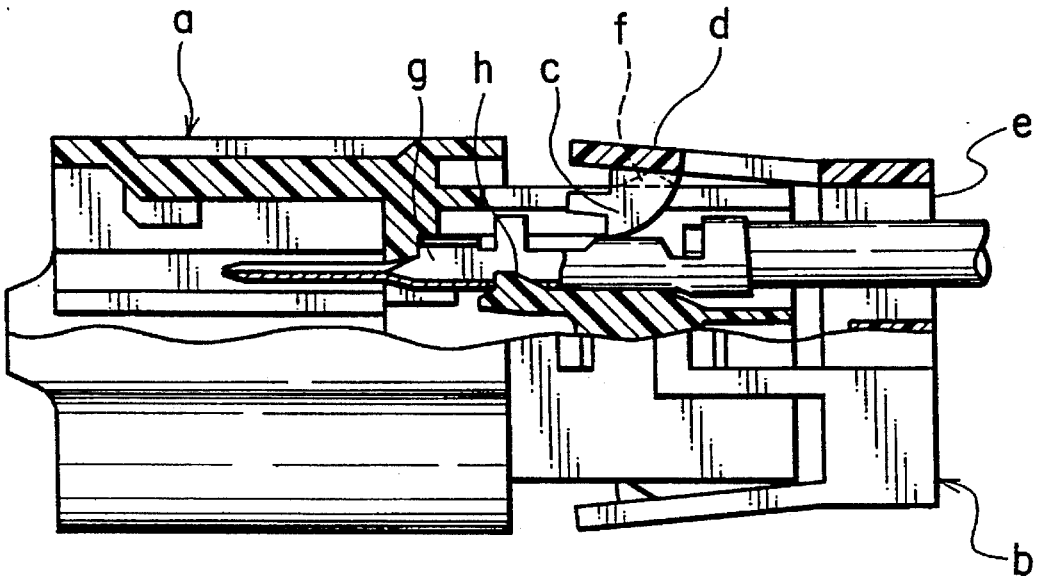
FIG. 8 PRIOR ART
FIG. 8 is a cross-sectional view of a connector housing and a terminal locking member shown in FIG. 7 in a preliminarily locked state.
Figure 9:
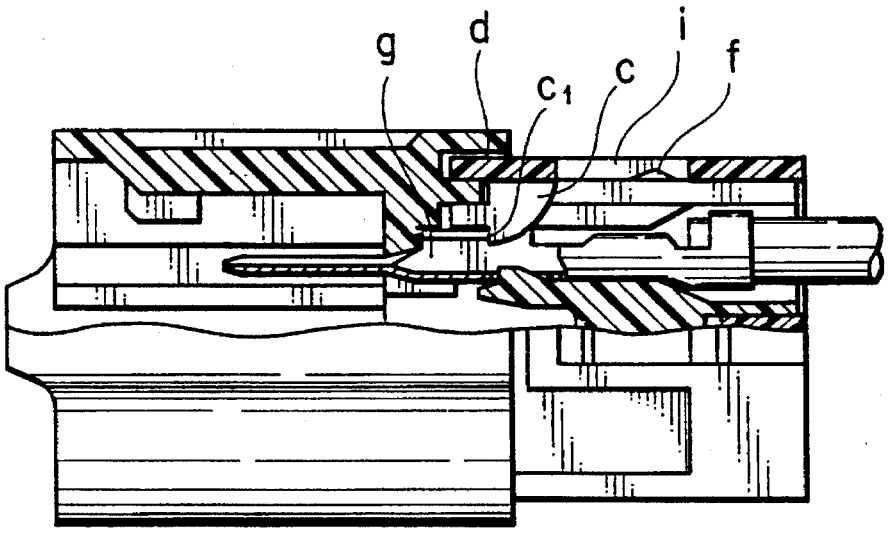
FIG. 9 PRIOR ART
FIG. 9 is a cross-sectional view of the connector housing and the terminal locking member shown in FIG. 7 in a fully locked state.

After the terminal C is inserted into the terminal accommodating cavity 2, the arms 10 of the terminal locking member B are pushed to further insert the terminal locking member into the cavity 2, which provides a fully locked state of the terminal C and the cavity 2 as illustrated in FIG. 6 wherein only the resilient supporting piece 8 behind locking piece 4 is shown for convenience. Under this condition, the fully locking projections 12 on the terminal locking member B are placed in engagement with the fully locking holes 13 of the connector housing A to maintain the fully locked state and the projections 10*c* are held in the concave portions 3*b* of the connector housing A.

In the process from the preliminarily locked state to the fully locked state, tips of the terminal locking portions 9 of the resilient supporting pieces 8 are in contact with slant faces 5*a* of guide projections 5 and slide thereon during the insertion of the terminal locking member B. Then, the tips of the terminal locking portions 9 abut the terminal C to doubly lock the terminal C in combination with the locking of the terminal C to the resilient locking pieces.

In order to disconnect the terminal from the terminal accommodating cavity 2, the terminal locking member B is pulled to obtain the preliminary locked state in which the lifting faces 9*a* ride on the lifting projections 6. As a result, the resilient supporting pieces 8 bend upwardly to allow the terminal C to be pulled off from the cavity 2 with ease.

The connector housing according to the present invention is provided with a terminal locking member to doubly lock a terminal through a preliminarily locked state and a fully locked state. Further, resilient supporting pieces of the terminal locking member are provided with lifting faces for engaging lifting projections at terminal supporting portions, which allows the resilient supporting pieces to securely bend at the preliminarily locked state. As a result, the insertion of the terminal is not interrupted by the resilient supporting pieces and the terminal is smoothly inserted into the terminal accommodating cavity.

When moved from the preliminarily locked state to the fully locked state, the terminal locking portions of the resilient supporting pieces slide along the slant faces of the guide projections so as to be introduced to the terminal, which securely and smoothly provides double locking of the terminal. Further, the locking force against the terminal is increased and the reliability of the locking is improved in the electrical connector according to the present invention.

What is claimed is:

1. An electrical connector comprising:

a plurality of terminals;

a housing;

terminal accommodating cavities in the housing;

an outer wall on said housing enclosing said terminal accommodating cavities;

a terminal locking member including a frame slidably attachable to the housing in a preliminary locked state and a fully locked state;

resilient terminal locking pieces formed on inner surfaces of said outer wall defining the respective terminal accommodating cavities of said housing for locking the terminals;

resilient terminal supporting pieces attached to said terminal locking member and having terminal locking portions for locking the terminals;

lifting projections in the terminal accommodating cavities for engaging said terminal locking portions to lift said resilient terminal supporting pieces at the preliminary locked state of the terminal locking member to permit the terminals to enter the terminal accommodating cavities and to be engaged with the resilient terminal locking pieces; and guide projections formed on said housing outer wall and disposed at spaced locations on the inner surfaces of the terminal accommodating cavities adjacent said terminals locking pieces, said guide projections having slant faces formed thereon for guiding each of the terminal locking portions of said terminal supporting pieces inwardly to a locking position with respect to the terminals while the terminal locking member is moved from the preliminary locked state to the fully locked state and for pressing the terminal supporting pieces inwardly to force the terminal locking portions against the terminals for doubly locking the terminals in combination with said terminal locking pieces at the fully locked state of the terminal locking member.

2. The electrical connector as claimed in claim 1, wherein said terminal accommodating cavities are vertically symmetrically arranged in two row.

3. The electrical connector as claimed in claim 1, wherein said terminal locking member has a shape of a frame, and the resilient terminal supporting pieces are attached to said frame in cantilever fashion.

4. The electrical connector as claimed in claim 1, wherein said lifting projections are formed on side walls of each of the terminal accommodating cavities.

5. The electrical connector as claimed in claim 1, wherein said resilient terminal supporting pieces extend from an inner surface of the frame of the terminal locking member and, with the terminal locking member installed in said housing, said terminal locking pieces are disposed between said terminal supporting pieces.

* * * * *